United States Patent [19]

Kohn

[11] Patent Number: 4,936,612

[45] Date of Patent: Jun. 26, 1990

[54] ONE-PIECE SINGLE ENGAGEMENT SEAL LOCK

[76] Inventor: Raymond F. Kohn, P.O. Box 448, Magnolia, Tex. 77355

[21] Appl. No.: 425,878

[22] Filed: Oct. 24, 1989

[51] Int. Cl.[5] ..... B65D 33/34

[52] U.S. Cl. ..... 292/327; 292/324; 403/326

[58] Field of Search ..... 403/326, 155, 154; 411/352, 353, 513, 514; 292/307 R, 327, 324

[56] References Cited

U.S. PATENT DOCUMENTS

| | | | |
|---|---|---|---|
| Re. 18,144 | 8/1931 | Heiermann | 403/155 |
| 429,461 | 6/1890 | Mandt | 403/326 X |
| 2,317,889 | 4/1943 | Danneman | 403/326 X |
| 2,847,238 | 8/1958 | Bolling, Jr. | 403/154 |
| 3,730,578 | 5/1973 | Gerlach | 292/318 |
| 3,770,307 | 11/1973 | Van Gompel | 292/307 R |
| 3,937,507 | 2/1976 | McCoag | 292/319 |
| 3,945,671 | 3/1976 | Gerlach | 292/323 |
| 3,980,337 | 9/1976 | Moberg/Lundberg | 292/319 |
| 3,994,521 | 11/1976 | Van Gompel | 292/319 |
| 4,049,303 | 9/1977 | Irwin et al. | 292/307 |
| 4,074,916 | 2/1978 | Schindler | 292/307 |
| 4,075,742 | 2/1978 | Remark | 24/211 R |
| 4,183,566 | 1/1980 | Yates | 292/317 |
| 4,280,726 | 7/1981 | McCoag | 292/327 |
| 4,342,477 | 8/1982 | McClure | 292/307 |
| 4,626,009 | 12/1986 | Burnett et al. | 292/327 |
| 4,640,538 | 2/1987 | Brammall | 292/323 |
| 4,690,443 | 1/1987 | Brammall | 292/307 |
| 4,747,631 | 5/1988 | Loynes et al. | 292/307 |
| 4,779,911 | 10/1988 | Wu | 292/318 |
| 4,802,699 | 2/1989 | Smith | 292/324 X |
| 4,815,908 | 3/1989 | Duran et al. | 411/353 |

*Primary Examiner*—Richard E. Moore

[57] ABSTRACT

A seal lock for use on the access doors of freight cars, trailer trucks and cargo containers or other applications requiring a one time use disposable locking device. In the preferred embodiment a C shaped locking body (10) having a locking mechanism within its upper leg member (14) and a blind hole within its lower leg member (16) and a locking pin (30) with its first end temporarily held in place by the locking mechanism within the upper leg member (14). The seal lock is positioned over the hasp and the locking pin is pushed with sufficient force to overcome the temporarily held position and is pushed through the aperture of the hasp until the first end of the locking pin (30) fully engages and is secured and supported by the blind hole within the lower leg member (16), while simultaneously the opposite end of the locking pin (30) permanently engages the locking mechanism within the upper leg member thereby securing the seal lock in place by means of a single engagement permanently secured locking means.

8 Claims, 3 Drawing Sheets

ONE-PIECE SINGLE ENGAGEMENT SEAL LOCK

BACKGROUND—FIELD OF INVENTION

This invention relates to a keyless lockable security device, specifically a hihg-security seal, or seal lock which secures the access doors of rail cars, trailer trucks, and cargo containers.

BACKGROUND—DESCRIPTION OF PRIOR ART

The access doors of railroad cars, trailer trucks, and cargo containers are customarily closed with a seal which is installed on the hasp of the access door. The primary function of the seal is to indicate if the doors had been opened by unauthorized personnel. Once secured, the seal should provide a permanent closure which cannot be opened without resulting in significant visible damage and the destruction of the seal device, which prevents its reuse. If the seal can be opened, by any means whatsoever, without resulting in visible damage and the destruction of the seal, thereby allowing the seal to be reused and appear intact, it has failed to perform its primary function.

Various forms of seals have been used in the past on the access doors of trucks, rail cars, and cargo containers. conventional seals frequently have consisted of a metal tape or a plastic band with a single securement member, when engaged therewith, it is impossible to remove the seal without the destruction of the securement member or the tape, or band. The prime purpose of these conventional seals has not been to secure the access doors from unauthorized entry, but for the purpose of indicating that such unauthorized access had been made.

In recent years the increase in thefts from trailer trucks, rail cars, and cargo containers has resulted in a new type of seal which embodies all the characteristics of a conventional seal in addition to providing increased strength and security by being constructed of heavier and more substantial materials, often times requiring the use of special tools to effect removal. These new types of seals have been rightly termed high-security seals, or seal locks.

Seal locks are a more practical solution than padlocks. It has been impractical to lock containers with padlocks, because of the problem of transferring keys or combinations. In addition, the complex mechanical construction of padlocks results in them being an expensive security alternative to seal locks. Once a seal lock is engaged, it is intended that it cannot be disengaged without destroying the seal, thereby preventing its reuse. Thus the single use of the seal resquires that the seal lock be low cost yet effectively provide a high level of security protection.

Heretofore several types of seal locks have been proposed. One type of seal lock construction requires the assembly of two separate pieces. Seal locks of this type are known from U.S. Pat. Nos. 4,690,443 to Brammall (1987), 4,280,726 to McCoag (1981), 4,075,742 to Remark (1978), 3,980,337 to Moberg and Lundberg (1976), 3,994,521 to Van Gompel (1976), 3,945,671 to Gerlach (1976), 3,937,507 to McCoag (1976), and 3,730,578 to Gerlach (1973). When a seal lock is constructed with two separate pieces, the loss of either piece, prior to use, renders the seal useless. Thus a person using this type of seal must maintain a careful inventory and count of both pieces to avoid misplacing one portion of the seal lock.

This is an inconventient and difficult task to perform while operating a busy cargo terminal facility, and when seal lock components are bulk packaged in cartons, the user would not be aware of any shortages of a given component until the last seals from the carton were used.

Several embodiments of the above mentioned prior art utilize a bolt member as one of the components of the seal lock. The typical hole diameter of the access door hasp limits the diameter of the shaft of the bolt to a maximum of ⅜" diameter. Such bolt member is typically a cold-headed part. The process of cold-heading has certain physical and economic limitations regarding the maximum diameter head that can be achieved when a ⅜" diameter shaft is used. In practice this manufacturing consideration limits the head diameter of the bolt member to ¾".

In many rail cars, truck trailers, and cargo containers the hole diameter of the locking hasp of the access doors is larger than ¾". This increased hole diameter is as a result of years of wear, manufacturing variations, or damage. In either case, a seal lock having a bolt member with a ¾" diameter head is useless on any hasp having a hole diameter of ¾" or larger. Padlock type seal locks recognize this limitation and utilize a "U" shaped shackle as shown on U.S. Pat. No. 3,937,507 to McCoag (1976).

High security seals, or seal locks, derive their strength by utilizing heavier metal components in their construction. The use of stronger materials increase the difficulty in breaking the seal lock open. When an attempt is made to open a seal lock by force, it is important that the seal perform its primary function, as stated above, and be destroyed by such an attempt. However, the same heavier metal components which increase the difficulty of breaking the seal open, also transfer most of the forces being applied to the seal, directly to the locking mechanism. My testing indicates that the relative strength of the locking mechanisms of seal locks is significantly less than the strength of the other components of the seal lock. Therefore, when sufficient forces are applied to the seal locks that have been previously proposed, the locking mechanisms release before any visible damage is done to the seal lock, thereby allowing the seal lock to be reused without apparent indications of tampering.

Seal locks previously proposed utilize a locking mechanism which is visible and accessible prior to installation. The locking mechanism can therefore be tampered with and manipulated to render the seal lock ineffective prior to being used, yet give the appearance of being intact.

Seal locks previously proposed require that one cut be made to remove the seal from the access door hasp. Whether that cut be made by a bolt cutter in the case of a seal lock using a bolt member or shackle, or a cable cutter in the case of a seal lock using a length of wire rope or cable. A seal lock which can be removed by means of a single cut is less secure than a seal which requires more than one cut to effect removal.

The present invention is designed toward overcoming one or more of the problems set forth above.

OBJECTS AND SUMMARY OF THE INVENTION

It is therefore, an object of this invention to provide a single engagement, permanently secured seal lock, which once engaged, cannot be removed without the complete destruction of the seal lock. It is a further object of this invention to provide a unique design by which the locking mechanism is completely concealed and inaccessible before, during and after installation. It is a further object of this invention that the locking mechanism be fully protected from the extreme pressures associated with a forced entry, thereby creating a stronger and more secure seal than has been available in the past.

Accordingly, besides the objects and advantages of a high-security seal or seal lock described in my above patent, several objects and advantages of the present invention overcome the problems presented by the prior art.

The present invention incorporates a single engagement permanently secured locking pin which is held in place by its first end within the upper leg of the locking body prior to use and cannot be removed from the locking body thereby creating a one-piece seal which eliminates the problem associated with lost components of two piece seals. When fully engaged, the locking pin is permanently secured by the locking mechanism located within the upper leg of the locking body. The blind hole within the lower leg of the locking body fully supports and secures the first end of the locking pin, while the locking mechanism within the upper leg of the locking body permanently engages and secures the opposite end of the locking pin. At all times, the locking mechanism is concealed from view and is not accessible thereby preventing tampering of the locking mechanism.

The present invention can be applied to any hasp, even one which has a hole diameter which is larger than ¾". This eliminates the problem associated with bolt type lock seals which have a ¾" diameter head on the bolt member and can easily pass through the hole in a hasp when such hole exceeds ¾".

When an attempt is made to open the present invention by force, the direct transfer of these forces to the locking mechanism is eliminated. The strength of the materials used in constructing the "C" shaped locking body and the locking pin combined with their unique relationship to each other resist the applied force, thereby protecting the locking mechanism from the direct pressure associated with a forced entry. The primary function of the locking mechanism of the present invention is to secure the locking pin in place and not provide the only resistance to a forced entry as is the case in prior art.

The present invention utilizes one locking mechanism, located within the upper leg of the locking body and a supporting blind hole located within the lower leg of the locking body which together secures and supports the locking pin in place. Such an arrangement requires that the locking pin be cut twice to remove the seal from the hasp. If the locking pin were cut once, the upper end of the locking pin would continue to be held in place by the locking mechanism located within the upper leg of the locking body. The remaining section of the locking pin would be held in place within the blind hole located in the lower leg of the locking body, therefore a second cut would have to be made on the locking pin to effect removal. The present invention requires that the locking pin be cut twice to effect removal of the seal lock, thereby increasing the level of security protection over previously proposed seal locks which only require a single cut to effect removal.

The preferred first embodiment, FIGS. 1, 2 and 3, of the present invention utilizes a blind hole in the lower leg of the locking body. Such an arrangement prevents the locking pin from being driven out of the locking body by the application of force to the exposed end of the locking pin. In the second embodiment, FIGS. 4 and 5, the locking pin is constructed with a head member on the exposed end of the locking pin as an additional means of preventing a forced entry.

The present invention, in its preferred embodiment. FIGS. 1, 2 and 3, utilizes a locking pin which when fully engaged, the top of the locking pin is flush with the top of the upper leg of the locking body, thereby eliminating any possible attempt to apply leverage and force to the locking pin in an attempt to pull the pin out of the locking body. In the second embodiment, FIGS. 4 and 5, the locking pin is constructed with a head member on the exposed end of the locking pin. When the seal lock is closed the head of the locking pin fits within the recessed portion of the upper leg of the locking body resulting in the top of the head member being flush with the top surface of the upper leg elemiminating any possible attempt to apply leverage and force to the head member of the locking pin.

The diameter of the locking pin in relation to the diameter of the holes within the upper leg and lower leg of the locking body are such that the locking pin can be pushed through the holes, but no tools or other foreign objects of sufficient size and rigidity can be passed between the locking pin and the interior wall of the hole. thereby preventing any attempt to manipulate the locking mechanism.

DRAWINGS AND FIGURES

Figure 1:
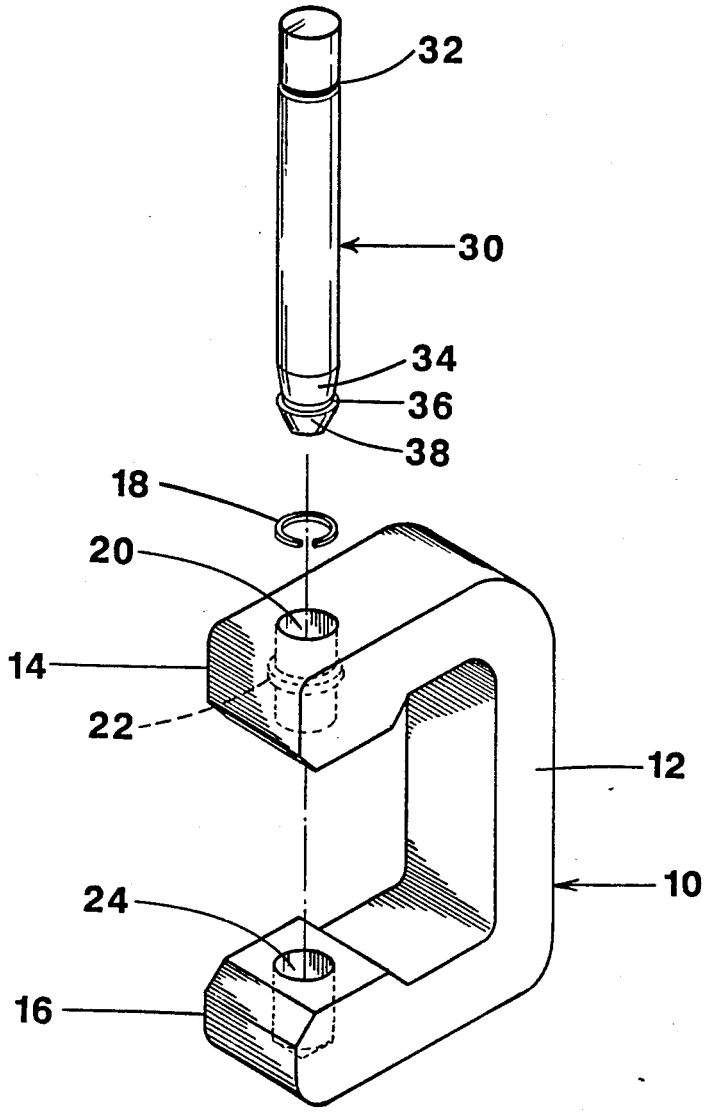
FIG. 1 is an exploded, perspective view of a preferred first embodiment of the single engagement, permanently secured seal lock.

FIGS. *6a*, *6b*, and *6c* are vertical sectional views of other embodiments of various locking body styles to accommodate different types of hasps. These views represent the seal lock in its permanently closed condition.

REFERENCE NUMERALS IN DRAWINGS

10—locking body
12—vertical member of locking body
14—upper leg member of locking body
16—lower leg member of locking body
18—upper split snap ring
20—hole in upper leg
22—recessed groove in hole of upper leg
24—blind hole in lower leg
30—locking pin
32—double sided groove (opposite end of locking pin)
34—tapered member
36—single sided groove (first end of locking pin)
38—conical tapered end
40—headed locking pin
42—head member
44—counter bore

DETAILED DESCRIPTION

Figure 2:
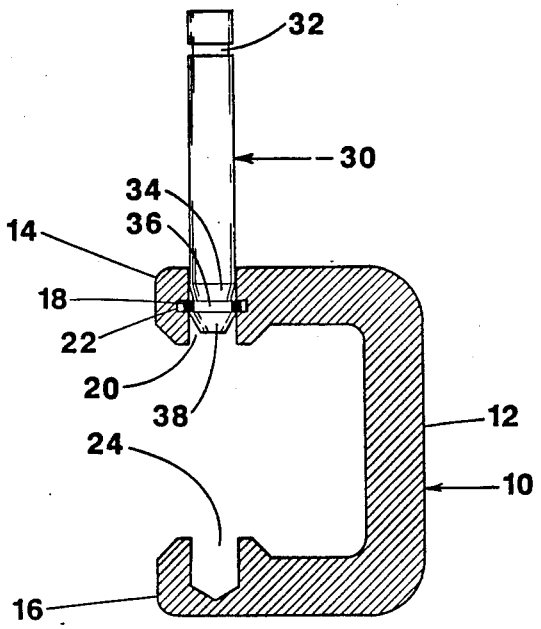
FIG. 2 is a vertical sectional view of the seal lock of FIG. 1 showing the first end of the locking pin temporarily held in place within the upper leg of the locking body. This view represents the seal lock in its opened condition.
Figure 3:
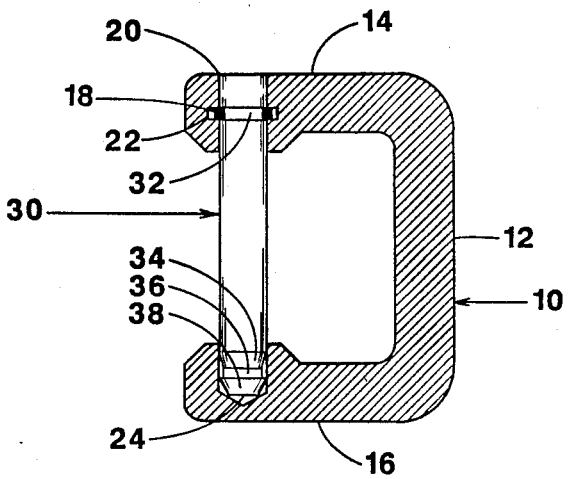
FIG. 3 is a vertical sectional view of the seal lock of FIG. 1 showing the opposite end of the locking pin permanently engaged with the locking mechanism located within the upper leg, and the first end of the locking pin supported and secured within the blind hole located within the lower leg. This view represents the seal lock in its permanently closed condition.

Referring to the drawings, a first embodiment of the single engagement seal lock of the present invention is shown in FIGS. 1, 2, and 3 and includes a "C" shaped locking body generally indicated at 10 and a locking pin indicated at 30.

Furthermore, locking body 10 and locking pin 30 may be formed of any conventional material such as steel, aluminum and many modern plastics and composite materials, all dependent on the strength and security required for the finished product.

More particularly to the unique configuration of the perferred embodiment of the present invention, a locking body 10 is formed with a vertical member 12, having an upper leg 14 and a parallel lower leg 16 which are perpendicular to vertical member 12. Upper leg 14 has a uniformly cylindrical hole indicated at 20, which passes through upper leg 14. Within hole 20 is an annular recessed groove 22 which is of a rectangular configuration to secure split snap ring 18 which fits within groove 22. The annular recessed groove 22 is of adequate depth to accommodate the split snap ring 18 when it is expanded by locking pin 30 as it passes through hole 20.

Lower leg 16 of locking body 10 has a uniformly cylindrical blind hole indicated at 24. The depth of blind hole 24 should be greater than the combined length of the tapered member 34, the annular single sided groove 36 and the conical tapered end 38 of locking pin 30. Therefore, the thickness of lower leg 16 must be sufficient to accommodate the combined length of the formed members 34, 36, and 38 of locking pin 30 and still provide sufficient material to create the blind hole 24. The blind hole should fully support and secure the first end of locking pin 30.

Hole 20 in upper leg 14 and blind hole 24 in lower leg 16 are vertically aligned on their respective center lines to allow locking pin 30 to pass through hole 20 and continue through until locking pin 30 passes into blind hole 24 in lower leg 16.

The distance as measured between the single sided groove 36 and double sided groove 32 of locking pin 30 is sufficient to allow the first end of locking pin 30 to enter and fully engage blind hole 24 within lower leg 16 while simultaneously having groove 32 of locking pin 30 align with the annular receessed groove 22 within hole 20 thereby engaging the locking means located within annular recessed groove 22 thus creating a single engagement permanently secured seal lock.

Split snap ring 18 is of rectangular configuration and is split cross-sectionally to form a C-ring. The split snap ring, 18 is formed from hard drawn spring steel wire and is resilient enough to accommodate a degree of expansion and contraction. The split snap ring 18 is compressed and inserted into its annular recessed groove 22. Once in place split snap ring expands to its normal condition and is held in place by the annular recessed groove 22.

Locking pin 30 has an outside diameter which is equal to the diameter of holes 20 and 24. Adequate minimal clearance is provided to allow locking pin 30 to slide within each hole 20 and 24, such minimal clearance is insufficient to permit the insertion of a foreign object of sufficient size and rigidity to manipulate the split snap ring 18.

The first end of locking pin 30 has a conical tapered end 38 which is inserted into hole 20 of upper leg 14. The conical tapered end 38 expands split snap ring 18 within annular recessed groove 22. When the annular single sided groove 36 of locking pin 30 becomes aligned with split snap ring 18, the split snap ring 18 snaps back to its original condition around single sided groove 36, thereby holding locking pin 30 in place. The single sided groove 36 prevents locking pin 30 from being removed due to the single parallel surface which has engaged split snap ring 18 while the tapered member 34 provides sufficient resistance thereby preventing locking pin 30 from continuing to move further through hole 20 without the application of added downward pressure to locking pin 30 thus providing a temporary engagement of locking pin 30. When split snap ring 18 is engaged, a portion of the cross-sectional area of split snap ring 18 is located within recessed groove 22 with the remaining portion located within single sided groove 36. Thus such an arrangement provides a temporary engagement of the first end of locking pin 30 within upper leg 14.

FIG. 2 shows the seal lock in its opened condition and ready for use with the first end of locking pin 30 temporarily held in place within hole 20 of upper leg 14. This view represents a one-piece unit having the locking mechanism completely concealed and inaccessible before installation as it would be presented to the user of this invention. The user of this invention would position the seal lock around the hasp with upper leg 14 and locking pin 30 positioned over the aperture of the hasp and in turn apply downward pressure to locking pin 30 sufficient to overcome the resistance created by tapered member 34 thus pushing locking pin 30 through hole 20 until the end of locking pin 30 is flush with the top surface of upper leg 14.

When sufficient downward force is applied to locking pin 30, tapered member 34 expands split snap ring 18 within recessed groove 22 allowing locking pin 30 to be slid downward through hole 20 and towards blind hole 24 in lower leg 16.

The first end of locking pin 30 is pushed into blind hole 24 of lower leg 16, thus securing and supporting the first end within lower leg 16. Simultaneously, as the first end of locking pin 30 fully engages blind hole 24 within lower leg 16, the annular double sided groove 32 becomes aligned with split snap ring 18 within upper leg 14 and split snap ring 18 snaps back to its original condition permanently securing the opposite end of locking pin 30 within upper leg 14.

FIG. 3 shows the seal lock in its permanently closed condition as it would be when used on a hasp, with the opposite end of locking pin 30 permanently secured in place by split snap ring 18 located within upper leg 14 and the first end of locking pin 30 fully secured and supported within blind hole 24 located within lower leg 16.

To effect removal of the present invention it is necessary for locking pin 30 to be cut twice with an appropriate tool. If only one cut were made split snap ring 18 would continue to hold the opposite end of locking pin 30 within upper leg 14 and blind hole 24 lower leg 16 would continue to support and secure the first end of locking pin 30 thereby preventing removal of the seal lock. To effect removal of the seal lock, locking pin 30 has to be cut twice. This added security feature offers a benefit not available in the prior art.

If extreme force was applied to the present invention in an effort to forcibly remove the seal, the unique design and positional relationship between locking body 10 and locking pin 30 would protect the split snap ring 18 and its respective grooves from the full impact of such forces. If extreme force were applied to this invention in an effort to pull this invention apart along its horizontal axis, locking bodys 10 and locking pin 30 would directly resist such forces. These horizontal forces are perpendicular to locking pin 30 thereby protecting split snap ring 18 from the direct impact of such forces. And, if extreme force were applied to this invention in an effort to pull this invention apart along its vertical axis, locking body 10 and in particular its vertical member 12 would directly resist such forces. These vertical forces would have to overcome the structural strength of locking body 10, thus again protecting split snap ring 18 and locking pin 30 from the direct impact of such force.

Figure 4:
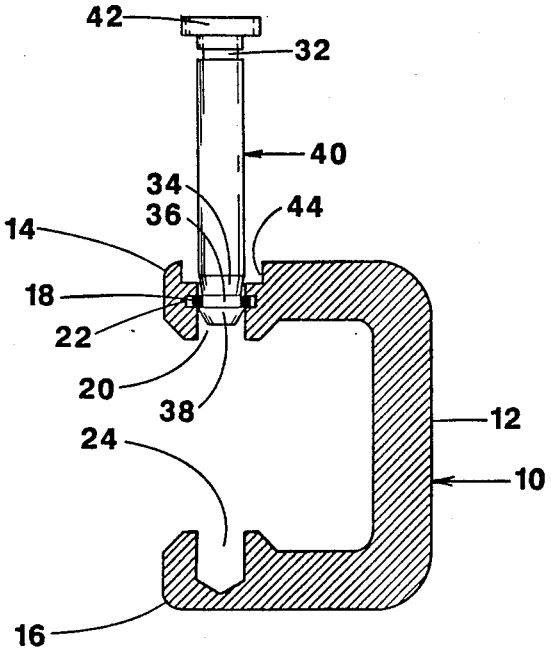
FIG. 4 is a vertical sectional view of a another embodiment showing the first end of a headed locking pin temporarily held in place within the upper leg of the locking body. This view represents the headed seal lock in its opened condition.
Figure 5:
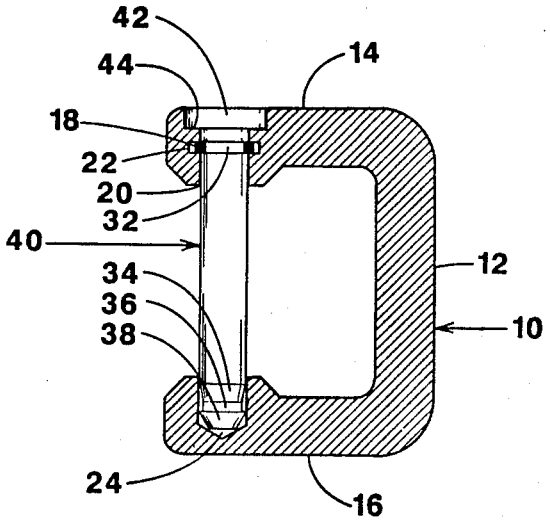
FIG. 5 is a vertical sectional view of the seal lock of FIG. 4 showing the opposite end of the headed locking pin permanently engaged with the locking mechanism located within the upper leg, and the first end of the headed locking pin supported and secured within the blind hole located within the lower leg. This view represents the headed seal lock in its permanently closed condition.

A further embodiment of theis invention is illustrated in FIGS. 4 and 5. All features indicated in the preferred embodiment are presnet in this embodiment with the addition of a headed locking pin 40 with its head member 42 and counter bore 44 within upper leg 14. Counter bore 44 accepts the full height of head member 42 so as to prevent any portion of head member 42 from projecting above the top surface of upper leg 14. FIG. 4 shows the headed seal lock in its opened condition and ready for use with the first end of headed locking pin 40 temporarily held in place within hole 20 of upper leg 14. This view represents a one-piece unit as it would be presented to the user of this invention. The user of this invention would position the seal lock around the hasp with upper leg 14 and locking pin 40 positioned over the aperture of the hasp and in turn apply downward pressure to headed locking pin 40 until the head of locking pin 40 flush with the top surface of upper leg 14.

FIG. 5 shows the headed seal lock in its permanemtly closed condition as it would be when used on a hasp, with headed locking pin 40 permanently secured in place at both ends by split snap ring 18 located within upper leg 14 and secured and supported by blind hole 24 located within lower leg 16. Head member 42 in shown fitted within counter bore 44 and flush with the top surface of upper leg 14.

RAMIFICATIONS AND SCOPE

Thus, the reader can see that the present invention provides a one-piece seal lock which protects the single engagement locking mechanism in two ways: First, the locking mechanism is completely concealed from view and inaccessible thereby preventing tampering before, during or after installation. Second, the unique configuration and relationship of the locking body locking pin protect the locking mechanism from the direct pressure of a forced entry. All in a design which can be used on any hasp regardless of the hole diameter within the hasp.

Figure 6A:
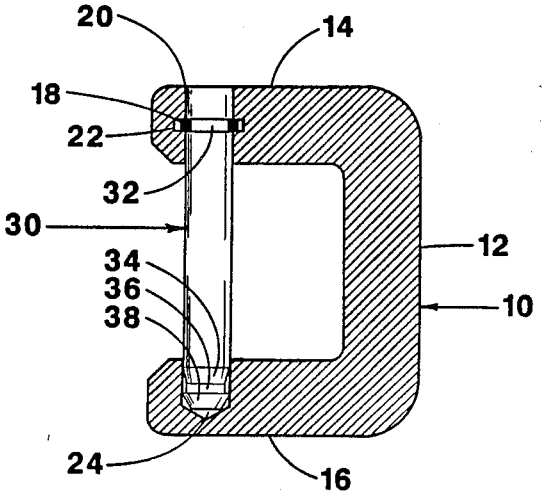
Figure 6B:
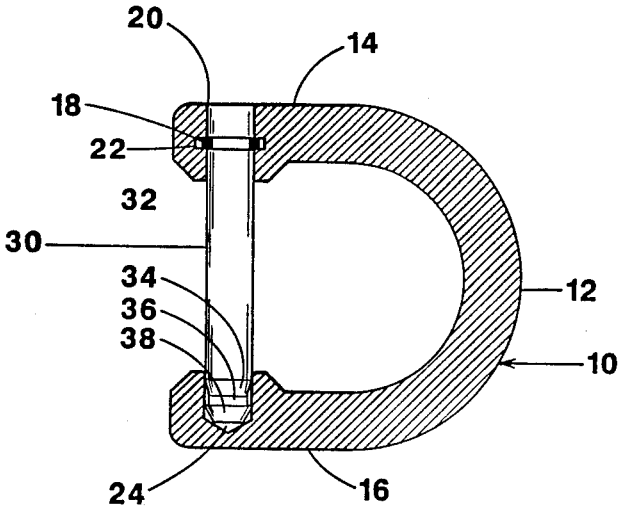
Figure 6C:
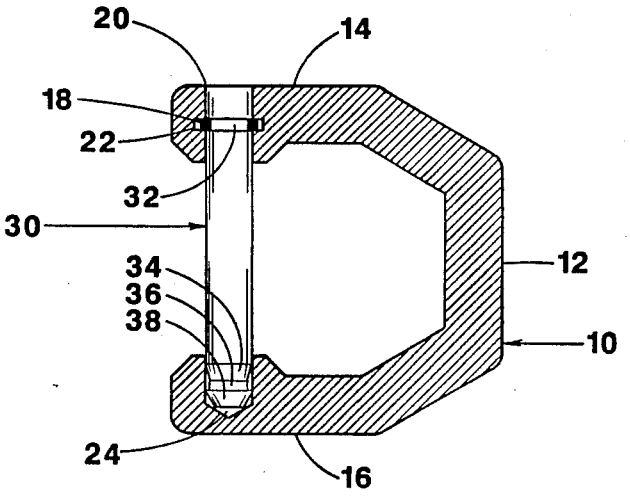

Different types of hasps or applications may require alternative locking body confugurations. FIGS. 6*a*, 6*b*, and 6*c* shows various alternative forms to vertical member 12 of locking body 10. All features of the preferred embodiment of the present invention are used within these alternative locking body configurations, the variations of vertical member 12 are presented to show the flexibility offered by this type of seal to accommodate different types of hasps and applications over prior art.

Although the above specifications contain many specificities, these should not be construed as limiting the scope of the invention but as merely providing illustrations of some of the presently preferred embodiments of this invention. For example, the locking body and its vertical member may have other shapes; the split snap ring can be round and the mating recessed grooves may have a radius to accommodate a round split snap ring.

Other modifications may be made in the device without departing from the scope of the invention, it is intended that all matter contained herein be interpreted in an illustrated and not a limiting sense.

Thus the scope of the invention should by determined by the appended claims and their legal equivalents. rather than by the examples given.

I claim as my invention:

1. A permanently secured single engagement seal lock comprising:

(a) a C shaped locking body comprised of a vertical member having a horizontal upper leg member and a horizontal lower leg member, (b) said upper leg member is parallel to said lower leg member and horizontal to said vertical member, (c) a vertical upper hole passing through said upper leg member having a locking means within, (d) a vertical lower hole within said lower leg member, (e) said upper hole and said lower hole are vertically aligned on their respective center lines, (f) a locking pin so dimensioned as to fit and slide snugly within said upper hole of said upper leg member and through to said lower hole of said lower leg member, (g) said locking pin having its first end shaped and arranged to effect a temporary locking engagement with said cooperating upper locking means located within said upper leg member, (h) said locking pin having an opposite end shaped and arranged to effect a permanent locking engagement with said cooperating upper locking means located within said upper leg member, (i) said locking pin is dimensioned to have the first end of said locking pin enter and be supported by said lower hole within said lower leg member while the opposite end of said locking pin effect a permanent locking engagement with said cooperating upper locking means within said upper leg member simultaneously, (j) with said locking body positioned around an aperture of a device to be sealed with said upper leg member positioned on one side of said aperture and said lower leg member positioned on the opposite side of said aperture and said locking pin positioned over said aperture said locking pin is pushed through said upper hole of said upper leg member with sufficient pressure to overcome the temporary locking engagement means contained therein thus the first end of said locking pin passes through said aperture of the device to be sealed and into said lower hole of said lower leg member at which time the opposite end of said locking pin permanently engages said cooperating upper locking means within said upper leg member thereby permanently securing said locking pin in place utilizing a single engagement locking means.

2. A seal lock as defined in claim 1 in which said lower hole of said lower leg member is a blind hole which does not pass completely through said lower leg member.

3. A seal lock as defined in claim 1 having the top surface of said locking pin being flush with the top surface of said upper leg member once said locking pin is fully and permanently engaged by said cooperating upper locking means.

4. A seal lock as defined in claim 1 having an annular recessed groove within said upper hole of said upper leg member with a resilient split snap ring therein.

5. A seal lock as defined in claim 4 having said locking pin with its first end having a conical tapered end adjacent to a single sided groove which is adjacent to a tapered member thereby creating a temporary locking means within said cooperating upper locking means of said upper leg member.

6. A seal lock as defined in claim 5 having said locking pin with its opposite end having as double sided groove thereby creating a permanent locking means within said cooperating upper locking means of said upper leg member.

7. A seal lock as defined in claim 1 having a headed locking pin mating with a counter bored recessed area within said upper leg member.

8. A seal lock as defined in claim 7 having the top surface of said headed locking pin flush with the top surface of said upper leg member once said headed locking pin is fully and permanently engaged by said cooperating upper locking means.

* * * * *